US011105274B1

(12) United States Patent
Ishii et al.

(10) Patent No.: US 11,105,274 B1
(45) Date of Patent: Aug. 31, 2021

(54) EXHAUST VALVE DEVICE FOR VEHICLE

(71) Applicant: MIKUNI CORPORATION, Tokyo (JP)

(72) Inventors: Toshiaki Ishii, Odawara (JP); Makoto Koyama, Odawara (JP); Daisuke Takayama, Odawara (JP); Naoki Tanaka, Odawara (JP)

(73) Assignee: MIKUNI CORPORATION, Tokyo (JP)

( * ) Notice: Subject to any disclaimer, the term of this patent is extended or adjusted under 35 U.S.C. 154(b) by 0 days.

(21) Appl. No.: 17/154,691

(22) Filed: Jan. 21, 2021

(30) Foreign Application Priority Data

Feb. 14, 2020 (JP) ..... JP2020-023454

(51) Int. Cl.
*F02D 9/08* (2006.01)
*F02D 9/10* (2006.01)

(52) U.S. Cl.
CPC ..... *F02D 9/1015* (2013.01); *F02D 9/107* (2013.01)

(58) Field of Classification Search
CPC ..... F02D 9/04; F02D 9/1045; F02D 9/1015; F01N 2240/36
USPC ..... 123/337
See application file for complete search history.

(56) References Cited

U.S. PATENT DOCUMENTS 5,401,001 A * 3/1995 Cook ..... F01N 3/2053 251/308
10,844,778 B2 * 11/2020 An ..... F02B 37/186
10,961,896 B2 * 3/2021 Zeumer ..... F01N 13/08
2004/0021119 A1 * 2/2004 Hattori ..... F16K 1/2261 251/306
2012/0326069 A1 * 12/2012 Takai ..... F16K 1/222 251/314
2018/0128189 A1 * 5/2018 Varelis ..... F02D 9/1045

FOREIGN PATENT DOCUMENTS

JP 2019-120252 7/2019

* cited by examiner

*Primary Examiner* — Long T Tran
*Assistant Examiner* — James J Kim

(57) ABSTRACT

An exhaust valve device for a vehicle includes: a valve element 7 axially supported by a rotating shaft 5 in a bore 4 of a valve body 3 produced through casting; sealing projections 21 and 22 integrally formed on an inner circumferential surface of the bore 4 to follow one side portion 7*a* and the other side portion 7*b* of an outer circumferential edge of the valve element 7 at a fully closed position; sealing surfaces 21*a* and 22*a* of the sealing projections 21 and 22, the right side portion 7*a* and the left side portion 7*b* of the valve element 7 at the fully closed position abutting respectively on the sealing surfaces; R-shaped corners 21*b* and 22*b* formed between the inner circumferential surface of the bore 4 and the sealing surfaces 21*a* and 22*a*; and diameter enlarged portions 25 formed in the inner circumferential surface of the bore 4 to enlarge the bore 4 that are adjacent respectively to the sealing surfaces 21*a* and 22*a* of the sealing projections 21 and 22 and correspond to lengths of the sealing surfaces 21*a* and 22*a*, and the valve element 7 has an outer shape enlarged to correspond to a height of the corners 21*b* and 22*b* on an outer circumferential side with formation of the diameter enlarged portions 25 at the fully closed position.

6 Claims, 13 Drawing Sheets

EXHAUST VALVE DEVICE FOR VEHICLE

CROSS REFERENCE TO RELATED APPLICATIONS

This Application claims priority from Japanese Patent Application No. 2020-023454 filed on Feb. 14, 2020, which is incorporated herein by reference in its entirety.

BACKGROUND OF THE INVENTION

Field of the Invention

The present invention relates to an exhaust valve device for a vehicle.

Description of the Related Art

Exhaust valve devices may be provided in exhaust pipes of engines mounted in four-wheel vehicles and two-wheel vehicles and are used for various purposes such as exhaust noise reduction and early warming-up of engines through exhaust pressure boosting. For example, the exhaust valve device disclosed in Japanese Patent Laid-Open No. 2019-120252 is adapted such that an upstream side and a downstream side of an exhaust pipe of an engine are caused to communicate with each other via a bore formed in a valve body and a valve element is supported to be able to be opened and closed in the bore by a rotating shaft axially supported by the valve body. A motor unit is secured to one side of the valve body via a bracket, and an output shaft thereof is coupled to the rotating shaft of the valve body. Therefore, if the rotating shaft is turned through driving of the motor unit, then the valve element is opened or closed, and in accordance with this, exhaust gas distributed in the exhaust pipe is restricted.

The exhaust valve device undergoes a temperature rise due to heat received from the exhaust gas and causes significant thermal expansion as compared with a throttle device that controls the intake amount of an engine, for example. Therefore, in a structure in which an outer circumferential edge of a valve element is caused to abut on a bore inner circumferential surface of a valve body at the time of full closing as in the throttle device, a valve element pinching phenomenon that is so-called stick may occur. Although a measure of forming a slight clearance between the valve element and the bore inner circumferential surface even at the time of full closing is also conceivable, exhaust gas cannot be isolated, and applications are thus significantly limited. Thus, the exhaust valve device adapted such that a pair of sealing projections with semicircular shapes are formed in the bore inner circumferential surface and the outer circumferential edge of the valve element that has been turned to a fully closed position is caused to abut each sealing projection to insulate exhaust gas has been proposed as disclosed in Japanese Patent Laid-Open No. 2019-120252.

Incidentally, although the valve body of the exhaust valve device is often produced by welding a steel pipe material or a sheet metal material in consideration of costs, component precision is degraded in that case, and it is difficult to insulate the exhaust gas. Although the valve body may be produced through casting as a measure, it is difficult to insulate the exhaust gas for the following reasons even according to the technique disclosed in Japanese Patent Laid-Open No. 2019-120252 in such a case.

In other words, each sealing projection is integrally formed at the time of casting of the valve body, and a corner between the bore inner circumferential surface and the sealing projection always has an R shape although the R shape is a minute shape. Hereinafter, the portion will be referred to as an R-shaped corner, and the portion with a flat surface shape on the inner circumferential side of the R-shaped corner will be referred to as a sealing surface. In order to prevent the outer circumferential edge of the valve element at the time of full closing from running on the R-shaped corner, the outer diameter of the valve element is set to be smaller than the inner diameter formed by the R-shaped corner. In this manner, since the outer circumferential edge abuts on the sealing surface of each sealing projection when the valve element is fully closed, exhaust gas is insulated at this portion with no problems.

On the other hand, both ends of the rotating shafts are axially supported by bearing provided at the valve body, and portions of the valve body other than the bearing are prevented from coming into contact with the rotating shaft. This is to prevent a situation in which a contact portion compresses the rotating shaft and interrupts turning thereof when the valve body and the rotating shaft causes expansion or contraction due to heat received from the exhaust gas. The same applies to the sealing projection, and an upper end and a lower end of each sealing projection with a semicircular shape are slightly separated from the rotating shaft and are prevented from coming into contact with the rotating shaft.

The outer circumferential edge of the valve element is separated from the bore inner circumferential surface on the inner circumferential side by at least a distance corresponding to the R-shaped corner as described above, and as a result, minute clearances that causes the upstream side and the downstream side to communicate with each other are formed at portions of a total of four locations between the upper end and the lower end of each sealing projection and the outer circumferential surface of the rotating shaft. These clearances will be referred to as leakage clearances below, and there has been a requirement for a measure for reducing an opening area of the leakage clearances in the related art since exhaust gas leaks on the downstream side via each leakage clearance even when the valve element is fully closed.

The present invention was made in order to solve such a problem, and an object thereof is to provide an exhaust valve device for a vehicle in which an opening area of a leakage clearance formed in a bore is reduced to allow for more reliable insulation of exhaust gas when a valve element is fully closed.

SUMMARY OF THE INVENTION

In order to achieve the aforementioned object, an exhaust valve device for a vehicle of the present invention includes: a valve body including a bore through which exhaust gas is distributed, the valve body being produced through casting; a valve element supported in the bore by a rotating shaft axially supported by the valve body and driven to be opened and closed between a fully opened position and a fully closed position by an actuator around the rotating shaft at the center; a pair of sealing projections integrally formed on an inner circumferential surface of the bore to follow one side portion and the other side portion of an outer circumferential edge of the valve element at the fully closed position with the rotating shaft interposed therebetween; a pair of sealing surfaces formed on the sealing projections, the one side portion and the other side portion of the outer circumferential edge of the valve element having been turned to the fully closed position abutting respectively on the sealing surfaces; a pair of R-shaped corners with R-shaped sections formed between the inner circumferential surface of the bore and the sealing surfaces when the valve body is casted; and a pair of extended portions formed in regions in the inner circumferential surface of the bore to enlarge the bore, the regions being adjacent respectively to the sealing surfaces of the sealing projections and correspond to lengths of the sealing surfaces, and the valve element has an outer shape enlarged to correspond to a height of the R-shaped corners on an outer circumferential side in the bore with formation of the extended portions at the fully closed position at which the one side portion and the other side portion of the outer circumferential edge are caused to abut on the sealing surfaces.

According to the exhaust valve device for a vehicle of the present invention, the opening area of leakage clearance formed in the bore is reduced, and it is thus possible to achieve more reliable insulation of exhaust gas when the valve element is fully closed.

DETAILED DESCRIPTION OF THE INVENTION

Hereinafter, an embodiment in which the present invention is implemented as an exhaust valve device for a four-wheel vehicle will be described.

Figure 1:
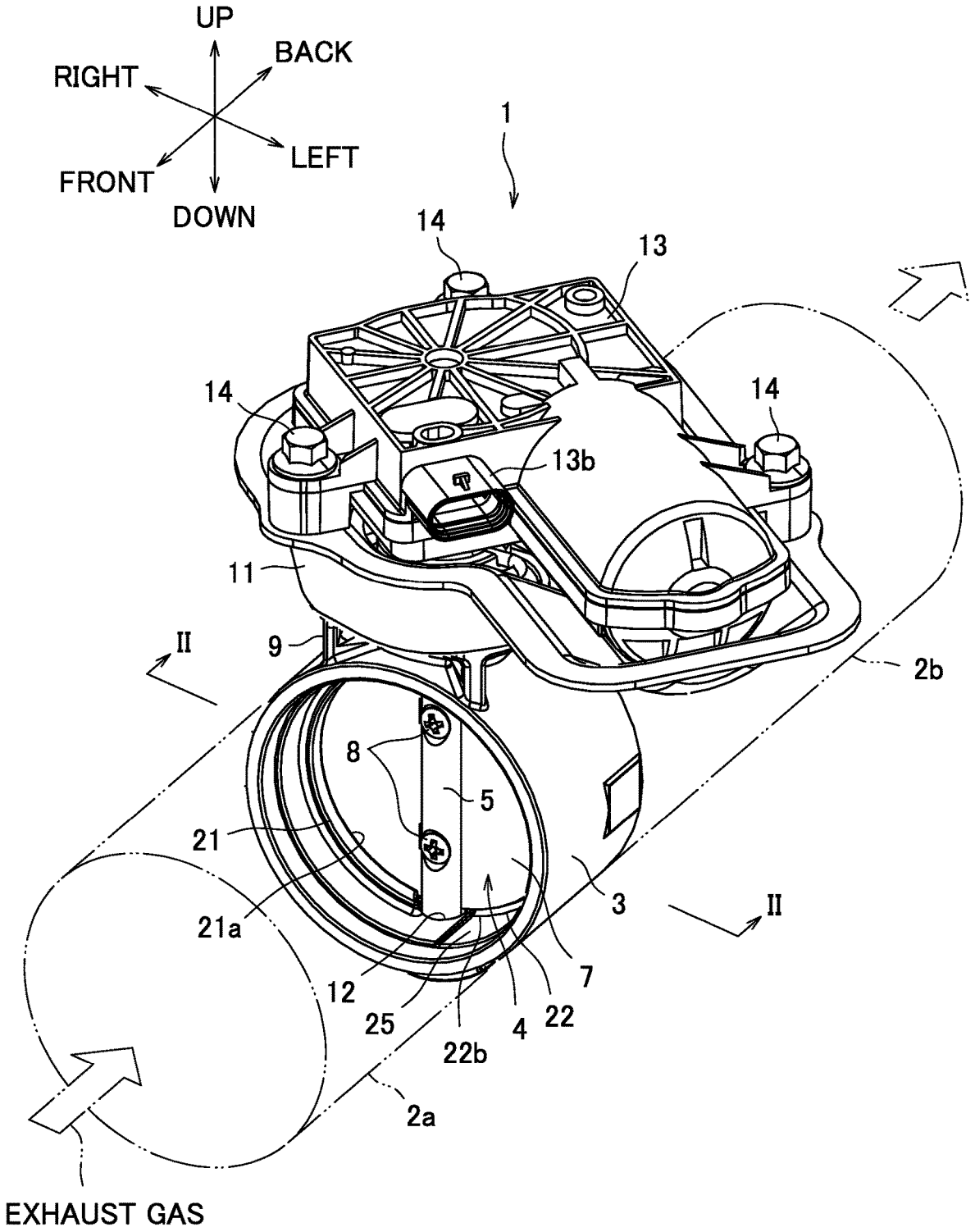
FIG. 1 is a perspective view illustrating an exhaust valve device according to an embodiment.

An exhaust valve device 1 is installed below a floor of a vehicle, which is not illustrated, in the posture illustrated in FIG. 1, and in the following description, front and back, left and right, and upper and lower directions will be expressed using the vehicle as a subject. Exhaust pipes 2*a* and 2*b* from an engine extend backward below the floor of the vehicle, the exhaust pipe 2*a* on the upstream side and the exhaust pipe 2*b* on the downstream side communicate with each other via a bore 4 formed in a valve body 3 of the exhaust valve device 1, and the exhaust pipe 2*b* on the downstream side is provided with a catalyst for purifying exhaust and a silencer although not illustrated.

Figure 2:
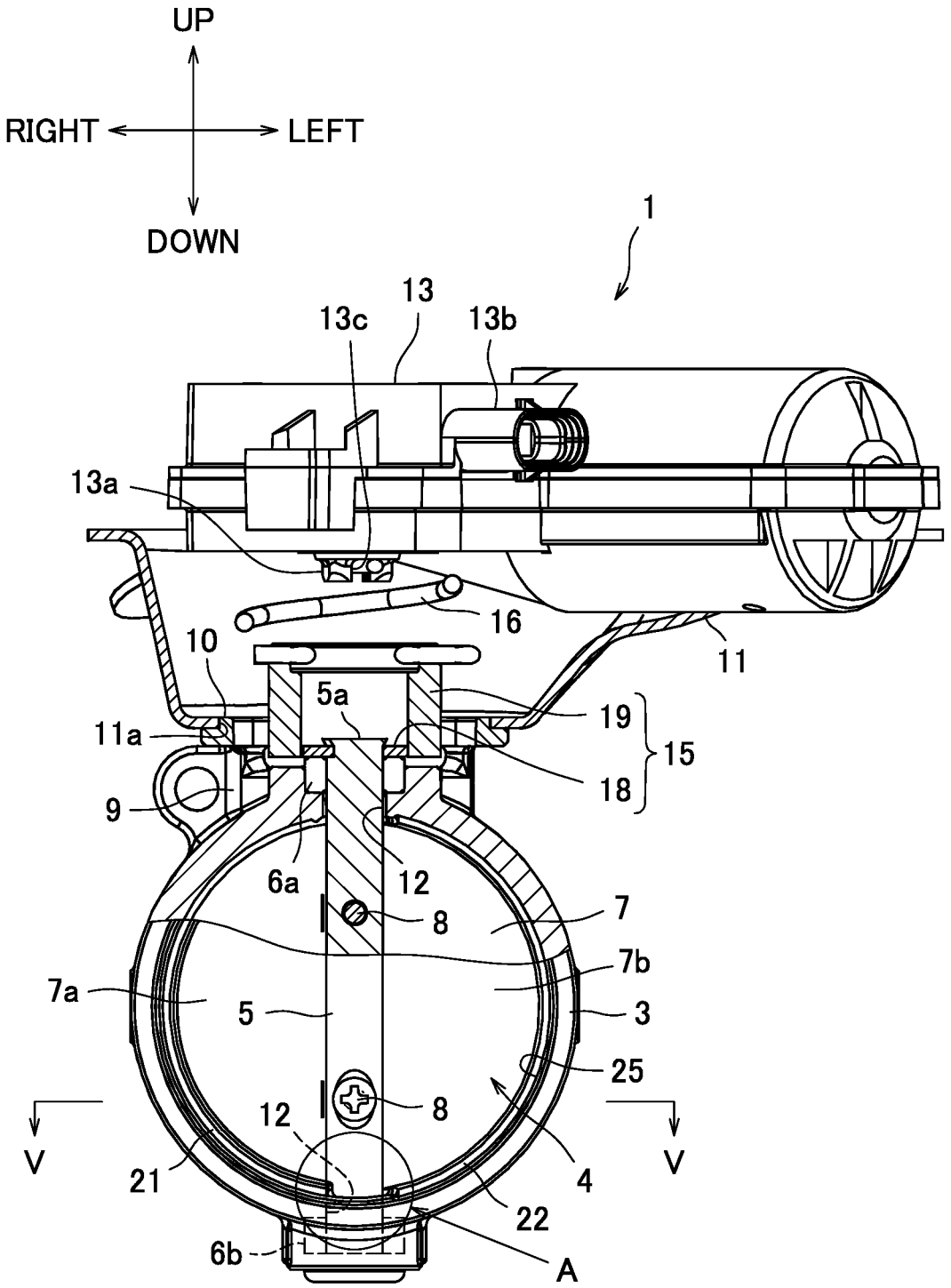
FIG. 2 is a sectional view along the line II-II in FIG. 1 illustrating the exhaust valve device.
Figure 3:
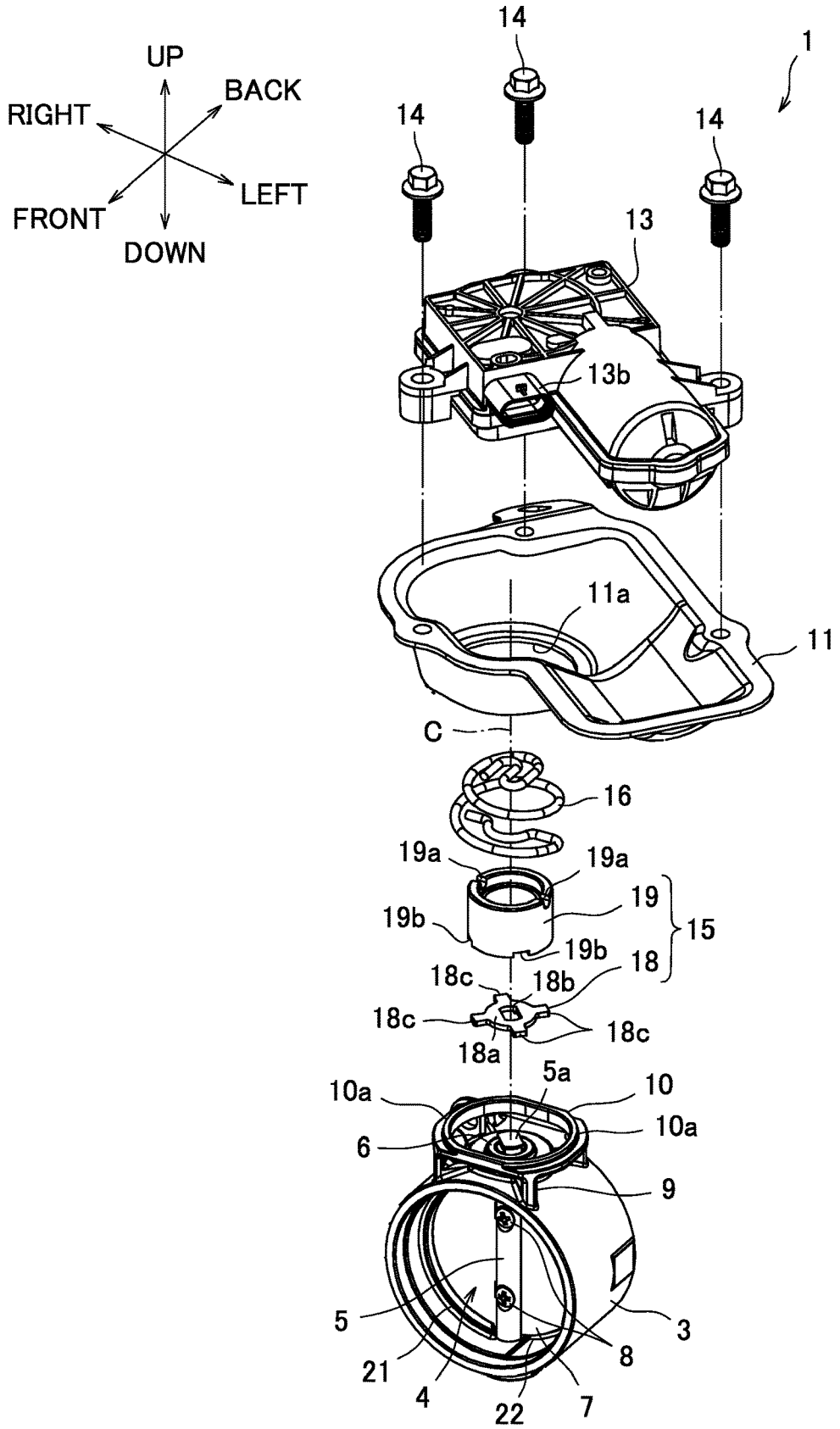
FIG. 3 is an exploded perspective view illustrating the exhaust valve device.
Figure 4:
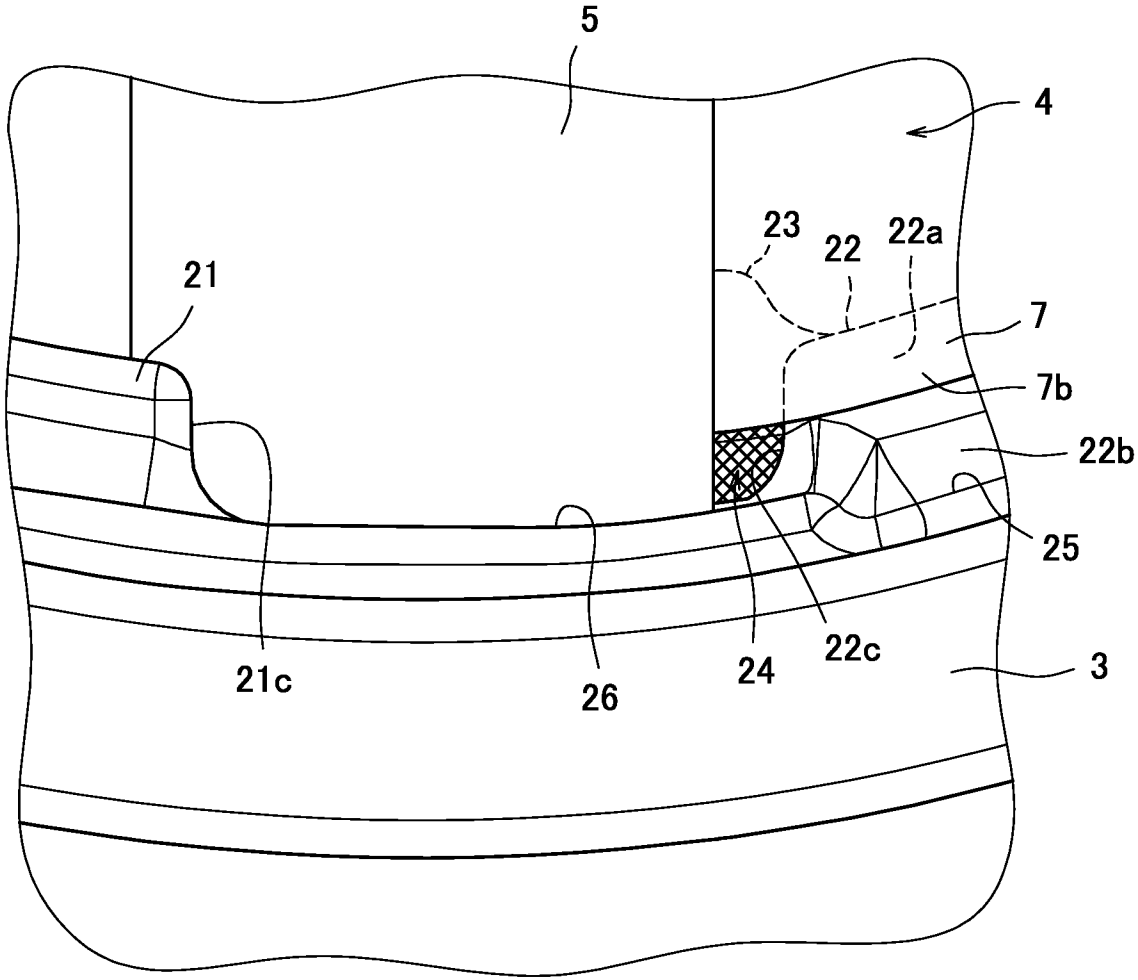
FIG. 4 is a detailed view of the portion A in FIG. 2 illustrating a leakage clearance.
Figure 4:
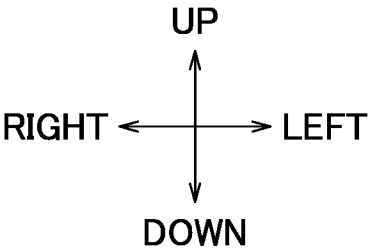

The valve body 3 is produced through casting, and a material with high heat resistance such as stainless steel is used. As illustrated in FIGS. 1 to 3, a rotating shaft 5 is disposed in the bore 4 with a circular section of the valve body 3, and an upper portion and a lower portion thereof are axially supported by bearings 6*a* and 6*b*, respectively, via axial holes 12 formed in the valve body 3 to be able to be turned.

A base portion 9 for securing a thermal insulation bracket 11 and a motor unit 13, which will be described later, are integrally formed above the valve body 3, such that an upper end of the rotating shaft 5 projects upward at the center of the base portion 9. A guide portion 10 with an annular shape around an axial line C of the rotating shaft 5 at the center is provided above the base portion 9 to project therefrom, and an outer circumferential surface thereof serves as guide surfaces 10*a*. The guide surfaces 10*a* are split left and right portions such that each of the guide surfaces 10*a* has an arc shape around the axial line C of the rotating shaft 5 at the center, by a front portion and a rear portion of the guide portion 10 being linearly chamfered in accordance with the front-back length of the valve body 3.

The thermal insulation bracket 11 produced by press-molding a steel sheet is disposed above the valve body 3, the thermal insulation bracket 11 has a dish shape recessed upward, and a guide hole 11*a* provided on one side thereof to penetrate therethrough is fitted onto the guide portion 10 of the valve body 3. Since the inner diameter of the guide hole 11*a* conforms to the outer diameter formed by the pair of guide surfaces 10*a* of the guide portion 10, it is possible to achieve an arbitrary change to an angle of the thermal insulation bracket 11 around the axial line C of the rotating shaft 5 at the center while bringing the inner circumference of the guide hole 11*a* into slide contact with the guide surfaces 10*a*, and the thermal insulation bracket 11 is secured to the valve body 3 through spot-welding after a prescribed securing angle is achieved. However, the structure for securing the thermal insulation bracket 11 is not limited thereto and can be arbitrarily changed.

The motor unit 13 as an actuator of the present invention is disposed on the thermal insulation bracket 11 and is secured thereto with three bolts 14, and an output shaft 13*a* of the motor unit 13 oriented downward is disposed on the axial line C of the rotating shaft 5 to face the upper end of the rotating shaft 5 at a predetermined interval in the thermal insulation bracket 11. Although not illustrated, the motor unit 13 incorporates a motor and a deceleration unit, such that the motor is operated through power supply via a connector 13*b* provided on one side and the rotation thereof is decelerated by the deceleration mechanism to drive and rotate the output shaft 13*a*.

As will be described below in detail, the output shaft 13*a* of the motor unit 13 and the rotating shaft 5 of the valve body 3 are coupled to each other via a rigid joint member 15 and a flexible joint member 16. Rotation of the output shaft 13*a* of the motor unit 13 is transmitted to the rotating shaft 5 via each of the joint members 15 and 16, and the valve element 7 is driven to be opened or closed, thereby restricting exhaust gas distributed through the exhaust pipes 2*a* and 2*b*.

As illustrated in FIGS. 2 and 3, the rigid joint member 15 is obtained by bonding a sealing element 18 with a flat plate shape and a transmission element 19 with a tubular shape through welding, and a material with high heat resistance such as a stainless steel is used. An axial hole 18*b* is provided on a sealing surface 18*a* of a sealing element 18 to penetrate therethrough, and arm portions 18*c* are provided at four locations equally dividing the periphery of the sealing surface 18*a* to extend therefrom. The upper end of the rotating shaft 5 projecting from above the base portion 9 of the valve body 3 is fitted into the axial hole 18*b* of the sealing element 18, a riveting portion 5*a* is formed through riveting, and in this manner, the sealing element 18 is secured to the upper end of the rotating shaft 5.

The sealing surface 18*a* of the sealing element 18 abuts on an upper axially supported portion of the valve body 3 from the upper side and seals a minute clearance formed by the bearing 6*a* to prevent exhaust gas distributed in the bore 4 from leaking. The transmission element 19 is disposed from the upper side above the sealing element 18, and the rigid joint member 15 is formed by each arm portion 18*c* of the sealing element 18 being fitted into an engagement groove 19*b* formed at a lower end of the transmission element 19 and by the arm portion 18*c* and the engagement groove 19*b* being welded to each other.

The flexible joint member 16 is produced by spirally winding a wire material such as a piano wire, an upper end thereof is fitted into a spring groove 13*c* formed in the output shaft 13*a*, and a lower end thereof is fitted into a spring groove 19*a* formed at an upper end of the transmission element of the rigid joint member 15. The flexible joint member 16 is interposed with elasticity between the output shaft 13*a* and the rigid joint member 15, thereby preventing dropping from a prescribed disposition state.

The flexible joint member 16 has such a spiral shape and thus has both thermal insulation properties and flexibility. Also, heat transmission from the valve body 3 that has been excessively heated by exhaust gas at a high temperature to the motor unit 13 is insulated due to the thermal insulation properties of the flexible joint member 16, and along with insulation of radiant heat from the valve body 3 achieved by the thermal insulation bracket 11, an effect of protecting the motor unit 13 from heat damage is obtained. In addition, the flexibility of the flexible joint member 16 has an effect of absorbing slight deviation of the axial line C between the side of the rigid joint member 15 and the side of the output shaft 13*a*.

A pair of left and right sealing projections 21 and 22 with semicircular shapes are integrally formed on the inner circumferential surface of the bore 4 of the valve body 3, and the outer circumferential edge abuts on each of the sealing projections 21 and 22 and insulates exhaust gas when the valve element 7 is fully closed. Details thereof will be described below.

Figure 5:
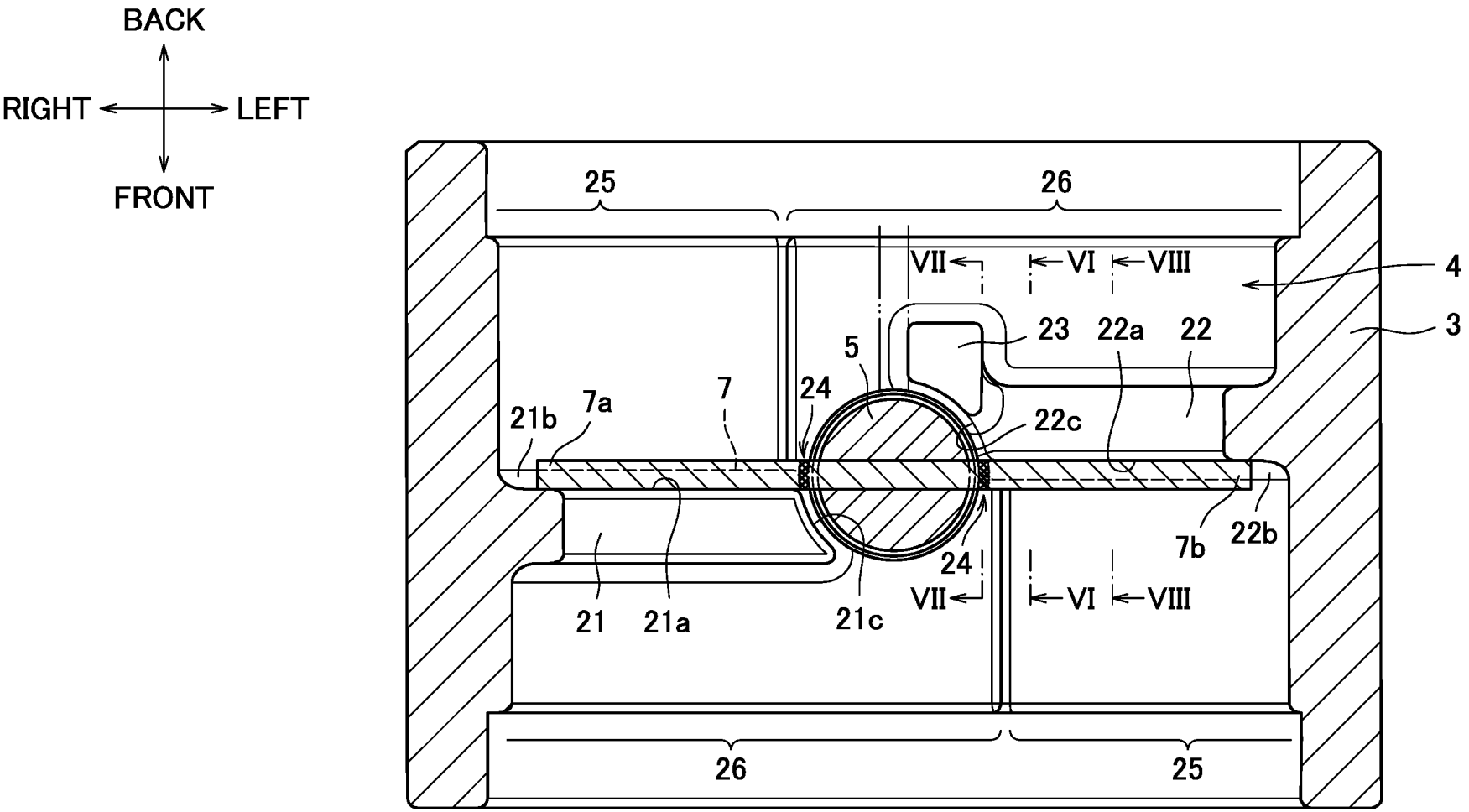
FIG. 5 is a sectional view along the line V-V in FIG. 2 illustrating a relationship between a sealing projection and a valve element.

The valve element 7 is turned around the rotating shaft 5 and is thus opened and closed between the fully closed position illustrated by the solid line in FIG. 5 and the fully opened position illustrated by the two-dotted dash line. The valve element 7 at the fully opened position allows distribution of exhaust gas in the bore 4 in a left-right direction facing posture, the valve element 7 at the fully closed position achieved by turning in the counterclockwise direction by 90° in FIG. 5 from the fully opened position is switched into a front-back direction facing posture, thereby insulating the distribution of exhaust gas. The outer circumferential edge of the valve element 7 is sectioned into a right side portion 7*a* and a left side portion 7*b* with semicircular shapes with the rotating shaft 5 interposed therebetween, and the right side portion 7*a* corresponds to one side portion of the present invention while the left side portion 7*b* corresponds to the other side portion of the present invention.

When the valve element 7 is turned to the fully closed position, the right side portion 7*a* of the outer circumferential edge is displaced forward to abut on the back surface of the sealing projection 21 on one side, and the left side portion 7*b* of the outer circumferential edge is displaced backward to abut on the front surface of the sealing projection 22 on the other side. Thus, both the sealing projections 21 and 22 are disposed to be offset at an interval equal to or greater than the thickness of the valve element 7 in the front-back direction, and specifically, the sealing projection 21 on one side is formed in front of the valve element 7 at the fully closed position while the sealing projection 22 on the other side is formed behind the valve element 7 at the fully closed position. Hereinafter, the sealing projection 21 on one side will be described as a front sealing projection, and the sealing projection 22 on the other side will be described as a back sealing projection to distinguish them for convenience of description.

As illustrated in FIGS. 2 and 5, the front sealing projection 21 is provided to extend in the circumferential direction along the right side of the inner circumferential surface of the bore 4 and has a semicircular shape while the back sealing projection 22 is provided to extend in the circumferential direction along the left side of the inner circumferential surface of the bore 4 and has a semicircular shape. Each of the sealing projections 21 and 22 has a square section, and the back surface of the front sealing projection 21 and the front surface of the back sealing projection 22 on which the outer circumferential edge of the valve element 7 abuts are formed to be flat to insulate exhaust gas and will be referred to as sealing surfaces 21*a* and 22*a* below.

As illustrated in FIGS. 2 and 5, lower ends 21*c* and 22*c* of the sealing projections 21 and 22 face the outer circumferential surface of the rotating shaft 5, have arc shapes, are slightly separated from the outer circumferential surface, and are prevented from coming into contact with the outer circumferential surface. Although not illustrated, upper ends of the sealing projections 21 and 22 also face the outer circumferential surface of the rotating shaft 5, have arc shapes, are slightly separated from the outer circumferential surface, and are prevented from coming into contact with the outer circumferential surface. The purpose of preventing the contact is to prevent a situation in which the contact portion compresses the rotating shaft 5 and interrupts turning thereof when the valve body 3 and the rotating shaft 5 cause expansion or contraction due to heat received from exhaust gas. Note that the inner circumferential surfaces of the axial holes 12 formed at upper and lower portions of the valve body 3 are also slightly separated from the outer circumferential surface of the rotating shaft 5 and are prevented from coming into contact with the outer circumferential surface.

As illustrated in FIG. 5, a full open stopper portion 23 is formed continuously from the lower end 22*c* of the back sealing projection 22, such that the valve element 7 that has been turned to the fully opened position abuts on the full open stopper portion 23 and turning thereof is restricted. Note that the full open stopper portion 23 is not necessarily formed integrally with the sealing projection 22 and may be provided at a location with no relation with the sealing projection 22.

Since each of the sealing projections 21 and 22 is integrally formed at the time of casting of the valve body 3, all the corners formed around the sealing projections 21 and 22 have R-shaped sections in the inner circumferential surface of the bore 4. Corners that relate to the gist of the present invention among these corners are only a corner 21*b* formed between the inner circumferential surface of the bore 4 and the sealing surface 21*a* of the front sealing projection 21 and extending in an arc shape and a corner 22*b* formed between the inner circumferential surface of the bore 4 and the sealing surface 22*a* of the back sealing projection 22 and extending in an arc shape. Thus, these corners 21*b* and 22*b* will be referred to as R-shaped corners in the following description.

If the outer circumferential edge of the valve element 7 when the valve element 7 is fully closed runs on the R-shaped corners 21*b* and 22*b*, then a clearance may be generated between each of the sealing surfaces 21*a* and 22*a* and the outer circumferential edge of the valve element 7 and may become a reason of leakage of exhaust gas. In order to prevent such a situation, the outer diameter of the valve element 7 is thus set to be smaller than the inner diameter formed by each of the R-shaped corners 21*b* and 22*b* positioned on the outer circumferential side. In this manner, the outer circumferential edge of the valve element 7 at the fully closed position properly abuts on each of the sealing surfaces 21*a* and 22*a*.

As a result, the outer circumferential edge of the valve element 7 is separated from the inner circumferential surface of the bore 4 on the inner circumferential side at least by the amount corresponding to the height H of the R-shaped corners 21*b* and 22*b*, and also, the upper and lower ends 21*c* and 22*c* of the sealing projections 21 and 22 are slightly separated from the outer circumferential surface of the rotating shaft 5 as described above. Therefore, minute leakage clearances 24 that causes the upstream side and the downstream side inside the bore 4 are caused to communicate with each other are formed at portions of a total of four locations between the upper and lower ends 21*c* and 22*c* of the sealing projections 21 and 22 and the outer circumferential surface of the rotating shaft 5 as illustrated by crosshatching in FIGS. 4 to 8, and a disadvantage that exhaust gas leaks on the downstream side via each leakage clearance 24 even if the valve element 7 is fully closed occurs as described in Description of the Related Art.

In view of such a disadvantage, the present inventor discovered a measure of reducing an opening area of each leakage clearance 24 by displacing, on the outer circumferential side, the R-shaped corners 21*b* and 22*b* that restricts the outer diameter of the valve element 7. In other words, the inner diameter of the bore 4 in a region corresponding to each of the sealing projections 21 and 22 in the circumferential direction in the bore 4 is enlarged, and the outer diameter of the valve element 7 is enlarged in order for the R-shaped corners 21*b* and 22*b* to be displaced on the outer circumferential side in the bore 4. Hereinafter, the regions with the enlarged inner diameter will be referred to as diameter enlarged portions 25, and the regions with no change from the original inner diameter of the bore 4 will be referred to as diameter non-enlarged portions 26. Since regions including the leakage clearances 24 in the vicinity of the rotating shaft 5 in the circumferential direction in the bore 4 are left as the diameter non-enlarged portions 26 with no enlargement of diameter, the opening area of the leakage clearances 24 is reduced only by the amount corresponding to the enlarged outer diameter of the valve element 7. These diameter enlarged portions 25 corresponds to an extended portion of the present invention.

In the embodiment, the diameter enlarged portions 25 are formed as follows to correspond to the sealing projections 21 and 22.

Figure 9:
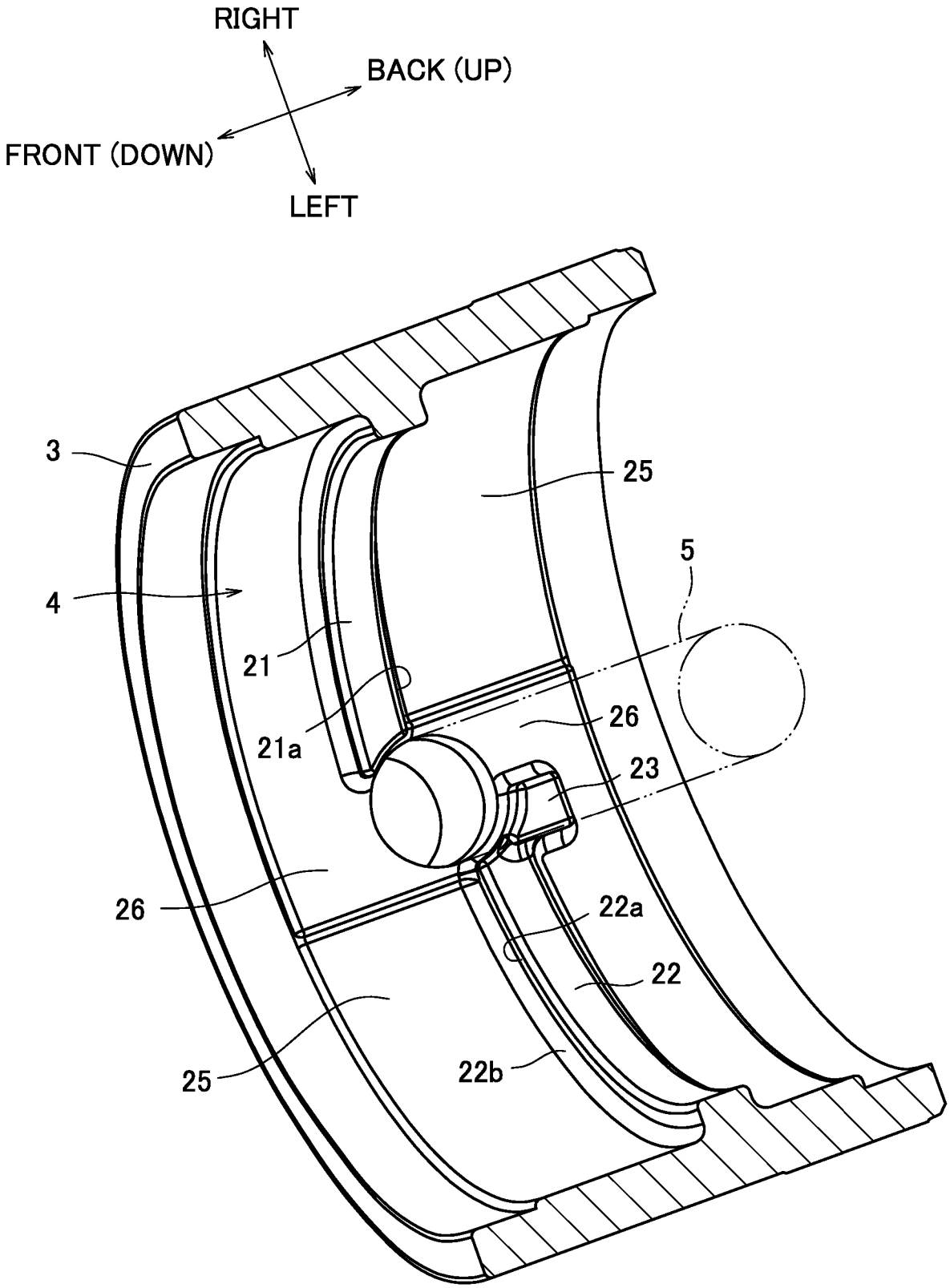
FIG. 9 is a sectional view of only a valve body illustrating a region where a diameter enlarged portion is formed in an inner circumferential surface of a bore.

As illustrated in FIG. 9, one of the diameter enlarged portions 25 is formed to be adjacent to the back side of the front sealing projection 21 while the other diameter enlarged portion 25 is formed to be adjacent to the front side of the back sealing projection 22, in the inner circumferential surface of the bore 4. Specifically, the one of the diameter enlarged portions 25 is formed by the diameter of the entire region on the back side from the sealing surface 21*a* corresponding to the back surface of the front sealing projection 21 being enlarged over the length corresponding to the sealing surface 21*a* in the circumferential direction. Similarly, the other diameter enlarged portion 25 is formed by the diameter of the entire region on the front side from the sealing surface 22*a* corresponding to the front surface of the back sealing projection 22 being enlarged over the length corresponding to the sealing surface 22*a* in the circumferential direction.

As a result, the regions where the diameter enlarged portions 25 are formed do not reach the inner circumferential surface of the bore 4 in the vicinity of the rotating shaft 5, and the diameter non-enlarged portions 26 are left over the entire peripheries of the upper portion and the lower portion of the rotating shaft 5. Also, if the valve element 7 is supported by the rotating shaft 5, then the leakage clearances 24 are formed at the portions of a total of four locations between the outer circumferential edge of the valve element 7 and the diameter non-enlarged portions 26 when the valve element 7 is fully closed.

Note that the diameter non-enlarged portions 26 are not necessarily formed over the entire periphery of the rotating shaft 5. For example, the diameter non-enlarged portions 26 may be formed only in regions where the leakage clearances 24 are formed when the valve element 7 is fully closed, specifically, only in regions overlapping the valve element 7 when the valve element 7 is fully closed in a plan view in FIG. 5 and illustrated by crosshatching on the left side and the right side with the rotating shaft 5 interposed therebetween.

Figure 6:
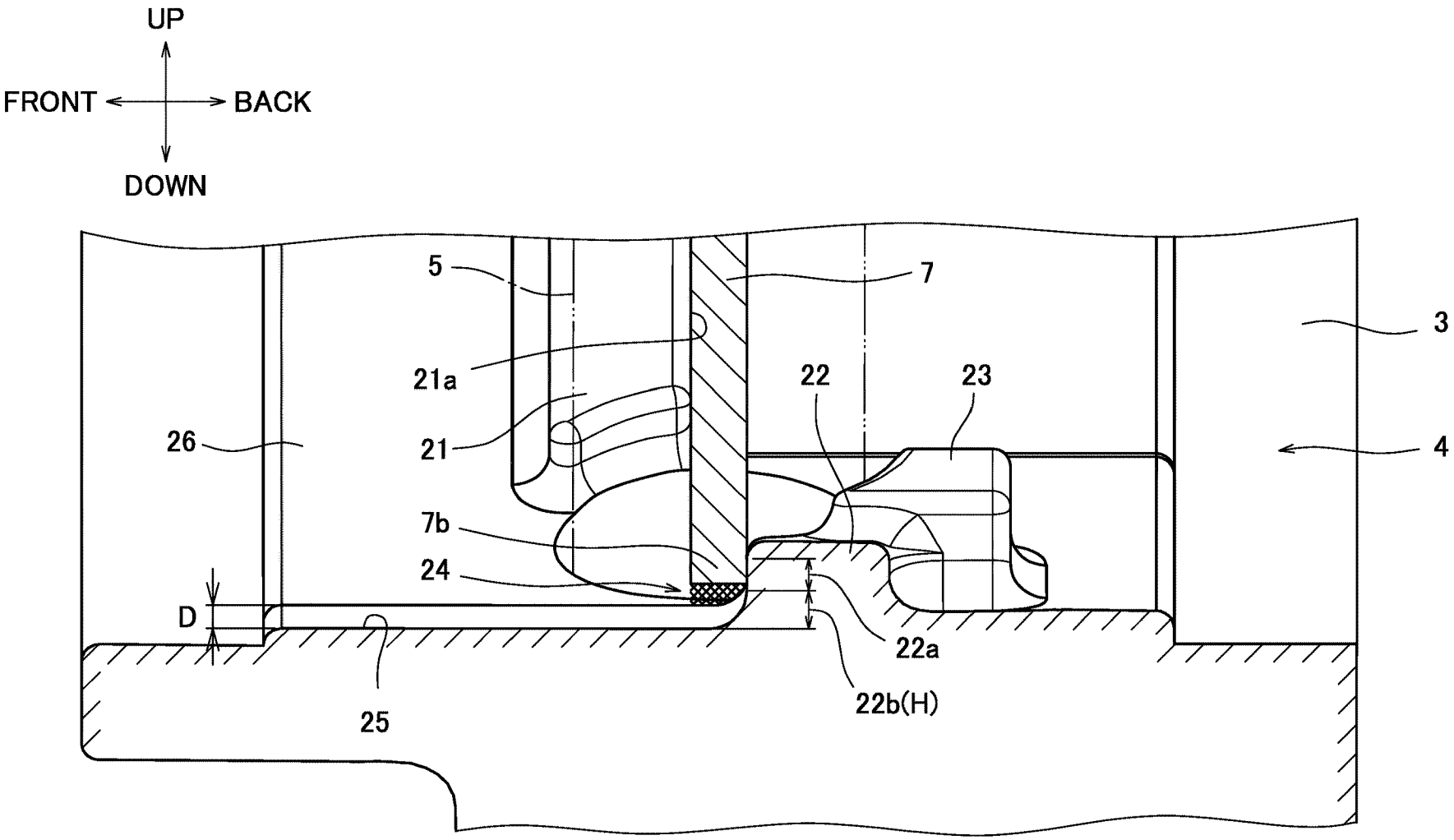
FIG. 6 is a sectional view along the line VI-VI in FIG. 5 illustrating a relationship between the sealing projection and the valve element.
Figure 7:
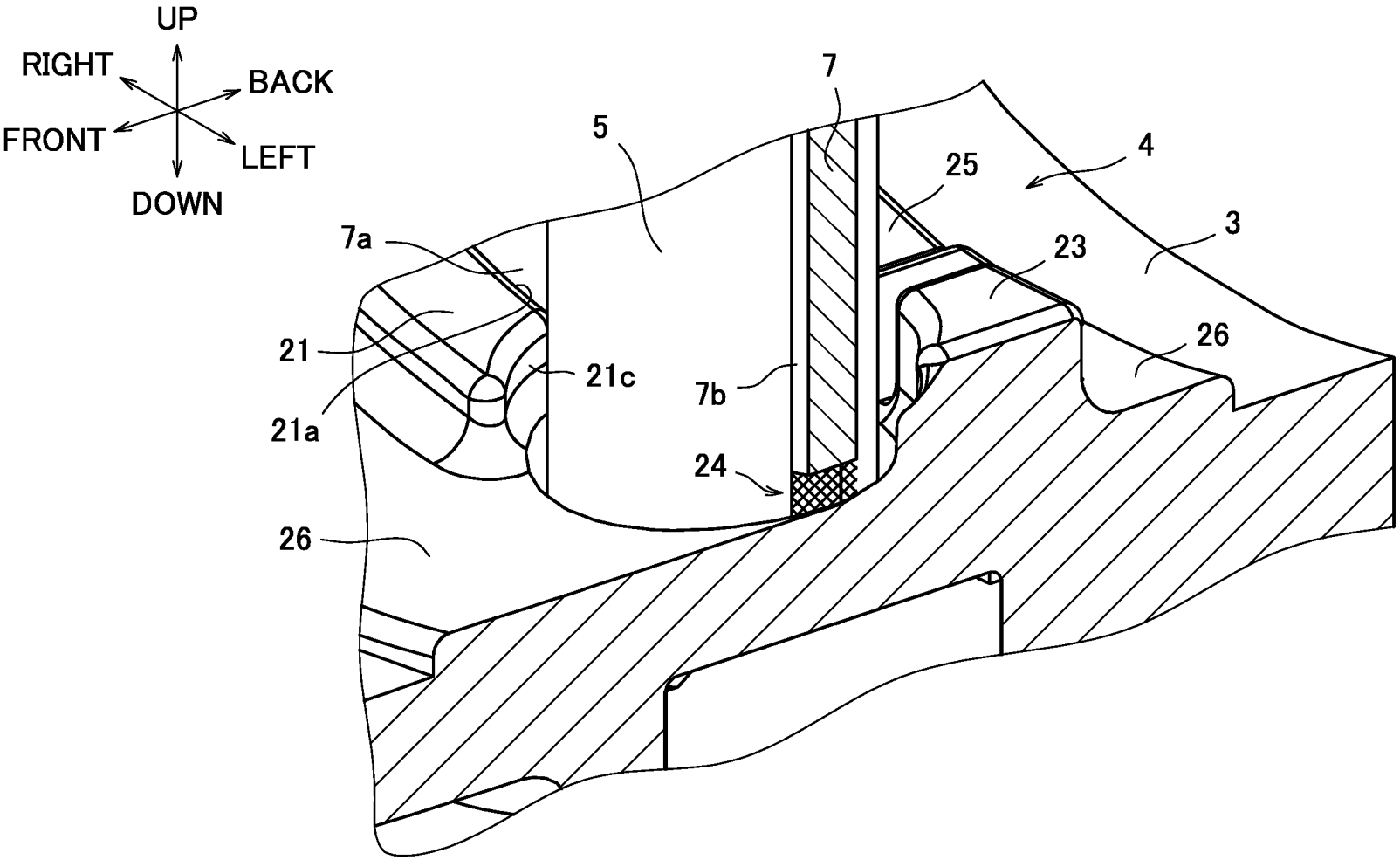
FIG. 7 is a sectional view along the line VII-VII in FIG. 5 illustrating the leakage clearance.
Figure 8:
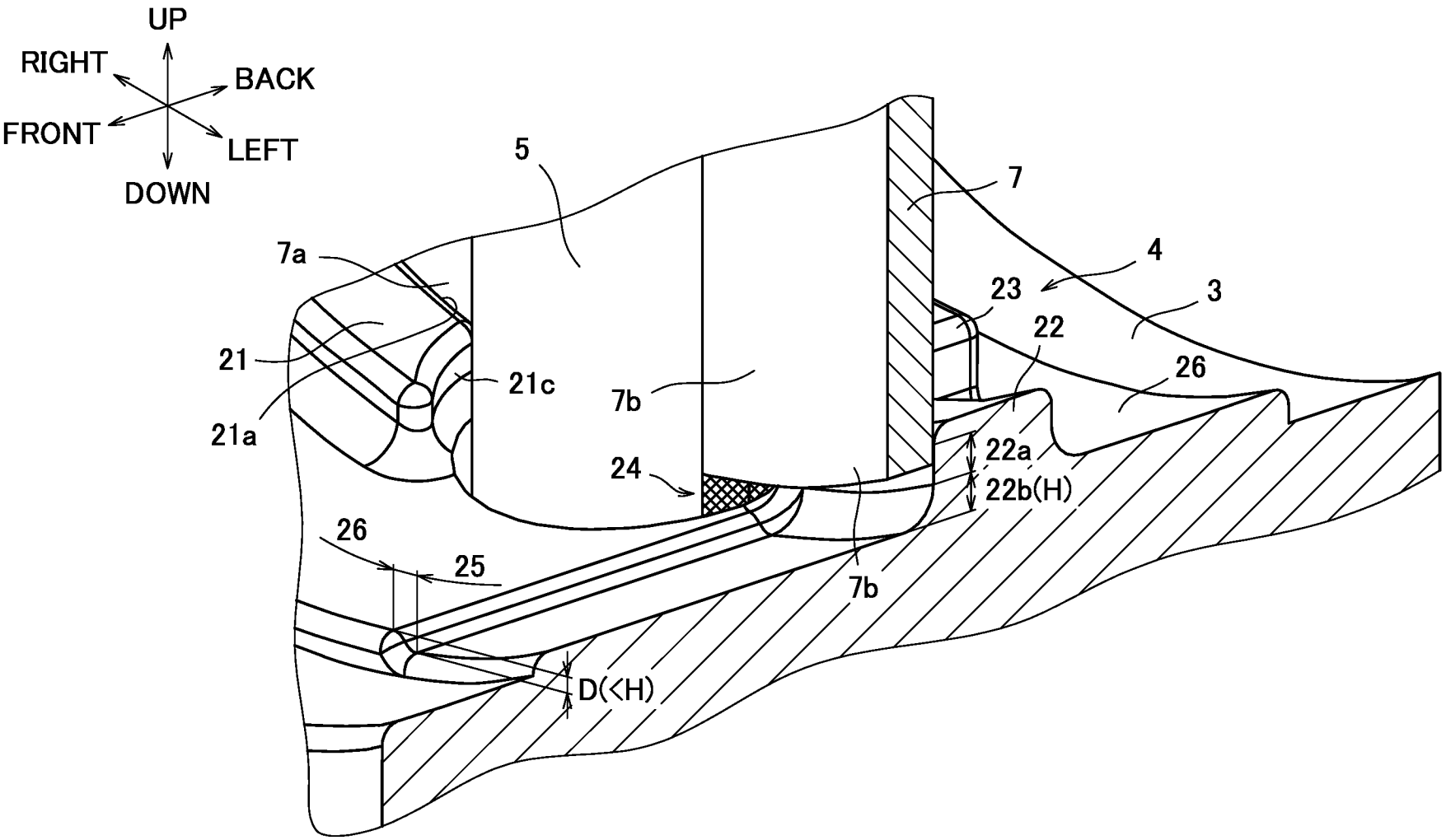
FIG. 8 is a sectional view along the line VIII-VIII in FIG. 5 illustrating a relationship between the sealing projection and the valve element.

The entire region of each diameter enlarged portion 25 is formed to have the same depth D, and each diameter enlarged portion 25 thus has an arc section with a radius that is greater than that of the diameter non-enlarged portions 26 corresponding to the original inner diameter of the bore 4 by the depth D. Note that in the embodiment, the depth D of the diameter enlarged portions 25 is set to be smaller than the height H of the R-shaped corners 21*b* and 22*b* of the sealing projections 21 and 22 as illustrated in FIGS. 6 and 8. The depth D of the diameter enlarged portions 25 is equalized in consideration of the point that the height H of the R-shaped corners 21*b* and 22*b* is substantially equal over the entire circumferential direction of the sealing projections 21 and 22. If a portion at which the depth D of the diameter enlarged portions 25 is shallow is present even at a part of the circumferential direction, the valve element 7 is restricted by the outer diameter corresponding to the portion, and the other portions of the diameter enlarged portions 25 formed to be deep just become a reason for unnecessarily enlarging the outer diameter of the valve body 3. Such a situation is prevented, and it is possible to more effectively enlarge the outer diameter of the valve element 7 through the formation of the diameter enlarged portions 25.

Through the formation of the diameter enlarged portions 25 as described above, the R-shaped corners 21*b* and 22*b* are displaced on the outer circumferential side in the bore 4 by the amount corresponding to the depth D of the diameter enlarged portions 25 relative to the diameter non-enlarged portions 26, and the outer diameter of the valve element 7 is enlarged by the amount corresponding to the displacement. As a result, the outer circumferential edge properly abuts on the sealing surfaces 21*a* and 22*a* without running on the R-shaped corners 21*b* and 22*b* of the sealing projections 21 and 22 when the valve element 7 is fully closed, and the exhaust valve device 1 thus normally achieves the function of restricting exhaust gas. The outer circumferential edge of the valve element 7 further approaches the diameter non-enlarged portions 26 with an original inner diameter of the bore 4 due to the enlargement of the outer diameter, and the opening area of the leakage clearances 24 formed between the outer circumferential edge and the diameter non-enlarged portions 26 is reduced. Therefore, the amount of exhaust gas leaking on the downstream side via each leakage clearance 24 is reduced, and it is possible to further reliably insulate the exhaust gas when the valve element 7 is fully closed.

Also, since exhaust gas distributed through each leakage clearance 24 when the valve element 7 is fully closed is affected by exhaust pulsation of the engine, and a flowing direction always varies, rattling sound is generated from the valve element 7 and the like. However, since the amount of exhaust gas distributed through each leakage clearance 24 is reduced, it is possible to reduce the noise. Further, since the exhaust valve device 1 normally achieves the function of restricting exhaust gas, and the sealing surfaces 21*a* and 21*b* properly abut on the outer circumferential edge of the valve element 7, an advantage that it is possible to reduce whistling noise caused by the flow rate being increased due to exhaust gas narrowed at the clearance between the sealing surfaces 21*a* and 22*a* and the outer circumferential edge of the valve element 7 is also obtained.

Note that the shape and the like of the diameter enlarged portions 25 are not limited to those described above. For example, although the diameter enlarged portions 25 are formed over the lengths in the circumferential direction corresponding to the sealing surface 21*a* of the front sealing projection 21 and the sealing surface 22*a* of the back sealing projection 22 in the aforementioned example, the present invention is not limited thereto. Since the R-shaped corners 21*b* and 22*b* are formed in the regions in the circumferential direction corresponding to the sealing surfaces 21*a* and 22*a*, and it is necessary to form the diameter enlarged portions 25 at least in the regions corresponding to the lengths of the sealing surfaces 21*a* and 22*a*. However, the diameter enlarged portions 25 may be extended up to regions in the circumferential direction beyond the sealing surfaces 21*a* and 22*a* as long as it is possible to include the leakage clearances 24 and to leave the diameter non-enlarged portions 26.

Also, in the aforementioned example, the depth D of the diameter enlarged portions 25 is set to be smaller than the height H of the R-shaped corners 21*b* and 22*b* of the sealing projections 21 and 22. However, in a case in which various dimensions such as the outer diameter of the valve element 7 and the inner diameter of the sealing projections 21 and 22 are kept with prescribed precision, in other words, in a case in which each component is assembled in a prescribed positional relationship, for example, the depth D of the diameter enlarged portions 25 may be increased up to the height H of the R-shaped corners 21*b* and 22*b* as an upper limit.

It is possible to further enlarge the outer diameter of the valve element 7 and to further reduce the opening area of the leakage clearances 24 as the depth D of the diameter enlarged portions 25 is increased. On the other hand, no advantage can be achieved if the depth D of the diameter enlarged portions 25 is increased beyond the height H of the R-shaped corners 21*b* and 22*b*, and the enlarged outer diameter of the valve body 3 even leads to an increase in size of the exhaust valve device 1. Therefore, in a case in which conditions related to part precision are satisfied, it is desirable that the depth D of the diameter enlarged portions 25 be set to be equal to the height H of the R-shaped corners 21*b* and 22*b*. Also, in a case in which the conditions related to part precision are not satisfied, it is only necessary to set the depth D of the diameter enlarged portions 25 to be slightly larger than the height H of the R-shaped corners 21*b* and 22*b* such that the outer circumferential edge of the valve element 7 does not run on the R-shaped corners 21*b* and 22*b* when the valve element 7 is fully closed, in consideration of a dimensional error.

Figure 10:
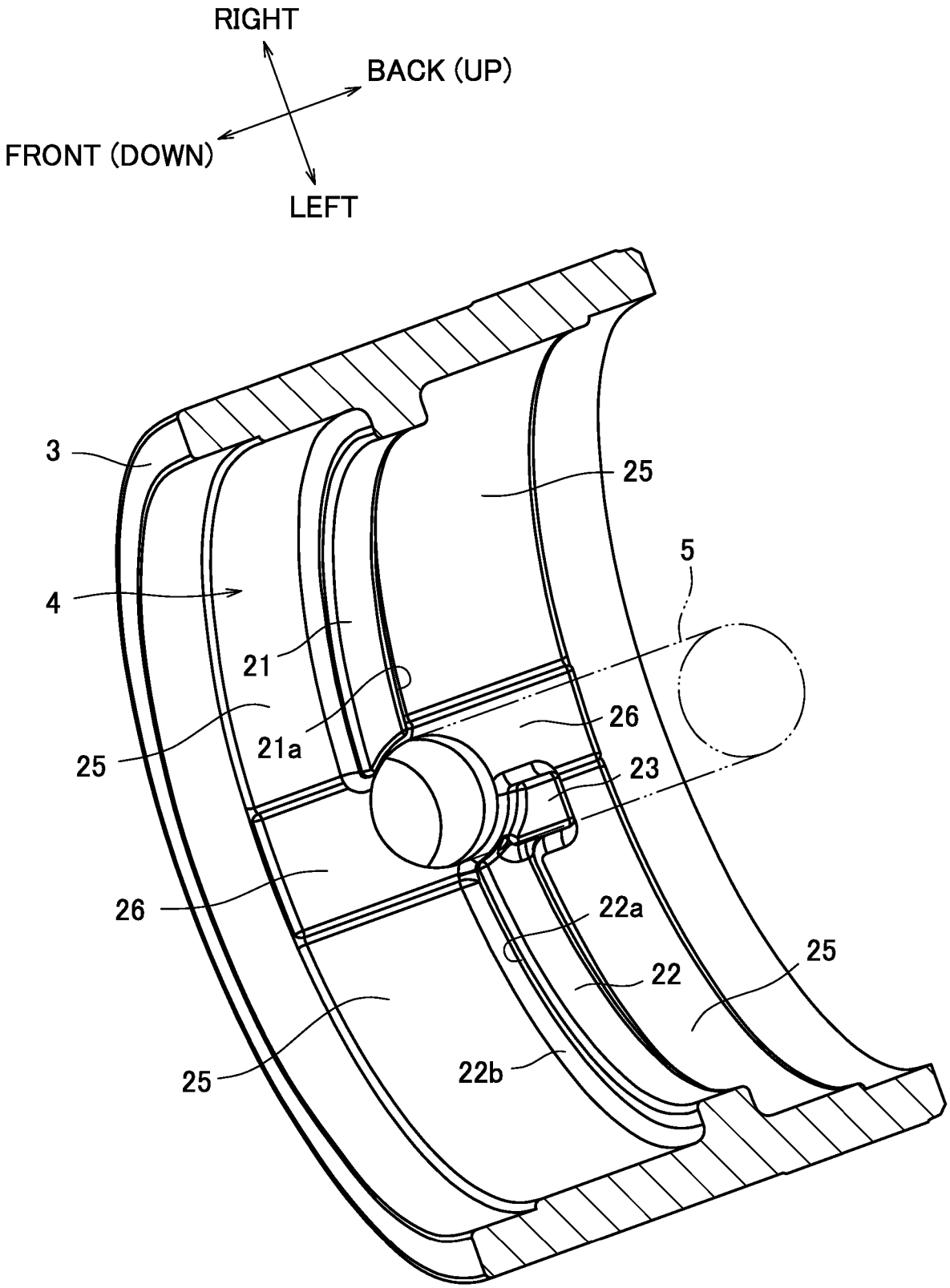
FIG. 10 is a sectional view illustrating another example in which diameter enlarged portions are formed in regions on the front side and the rear side of each sealing projection.

Although the entire region on the back side from the sealing surface 21*a* of the front sealing projection 21 and the entire region on the front side from the sealing surface 22*a* of the back sealing projection 22 in the inner circumferential surface of the bore 4 are defined as the diameter enlarged portions 25 in the aforementioned example, the present invention is not limited thereto. Both regions on the front side and the back side of the sealing projections 21 and 22 may be defined as the diameter enlarged portions 25 as illustrated in FIG. 10, for example. Since the diameter non-enlarged portions 26 are left over the entire periphery of the rotating shaft 5 even in this case, it is possible to reduce the leakage clearance 24 in size with no problem.

Figure 11:
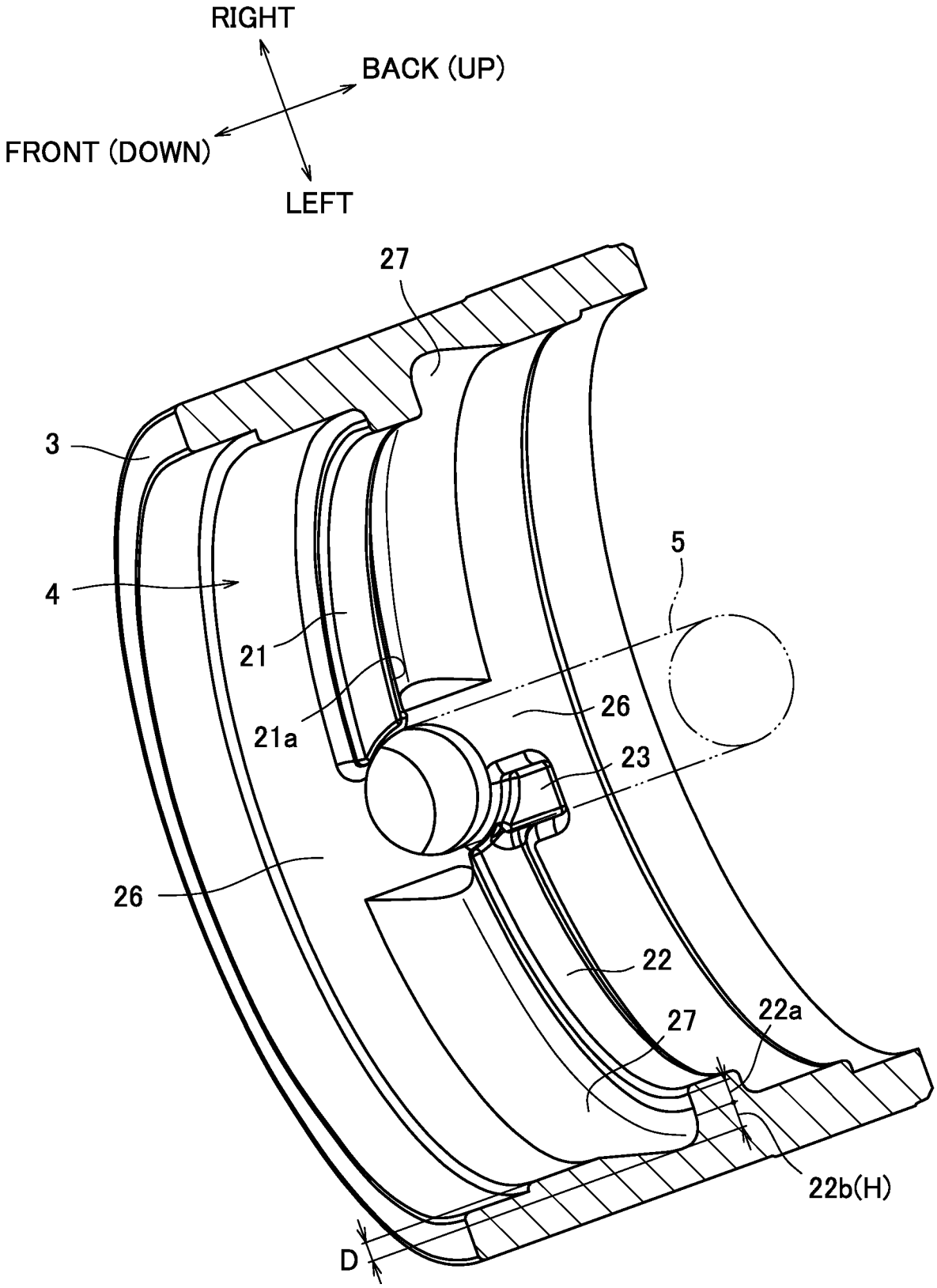
FIG. 11 is a sectional view illustrating yet another example in which a diameter enlarged portion with a slope-shaped section is formed.

Also, diameter enlarged portions 27 with slope-shaped sections in which the depth D is gradually reduced further away from the sealing surfaces 21*a* and 22*a* may be formed in regions limited on the front-back direction that are adjacent to the sides of the sealing surfaces 21*a* and 22*a* of the sealing projections 21 and 22 as illustrated in FIG. 11, for example. Portions of a mold for casting the valve body 3 corresponding to the diameter enlarged portions 25 have an undercut shape and can be formed through so-called forced extraction. Also, it is possible to obtain another advantage that exhaust gas can be more smoothly distributed in the bore 4 by forming the diameter enlarged portions 25 to have gentle sloped-shaped sections.

Aspects of the present invention are not limited to this embodiment. Although the aforementioned embodiment is implemented as the exhaust valve device 1 for a four-wheel vehicle, the embodiment may be applied to an exhaust valve device for a two-wheel vehicle or a three-wheel vehicle instead, for example.

Figure 12:
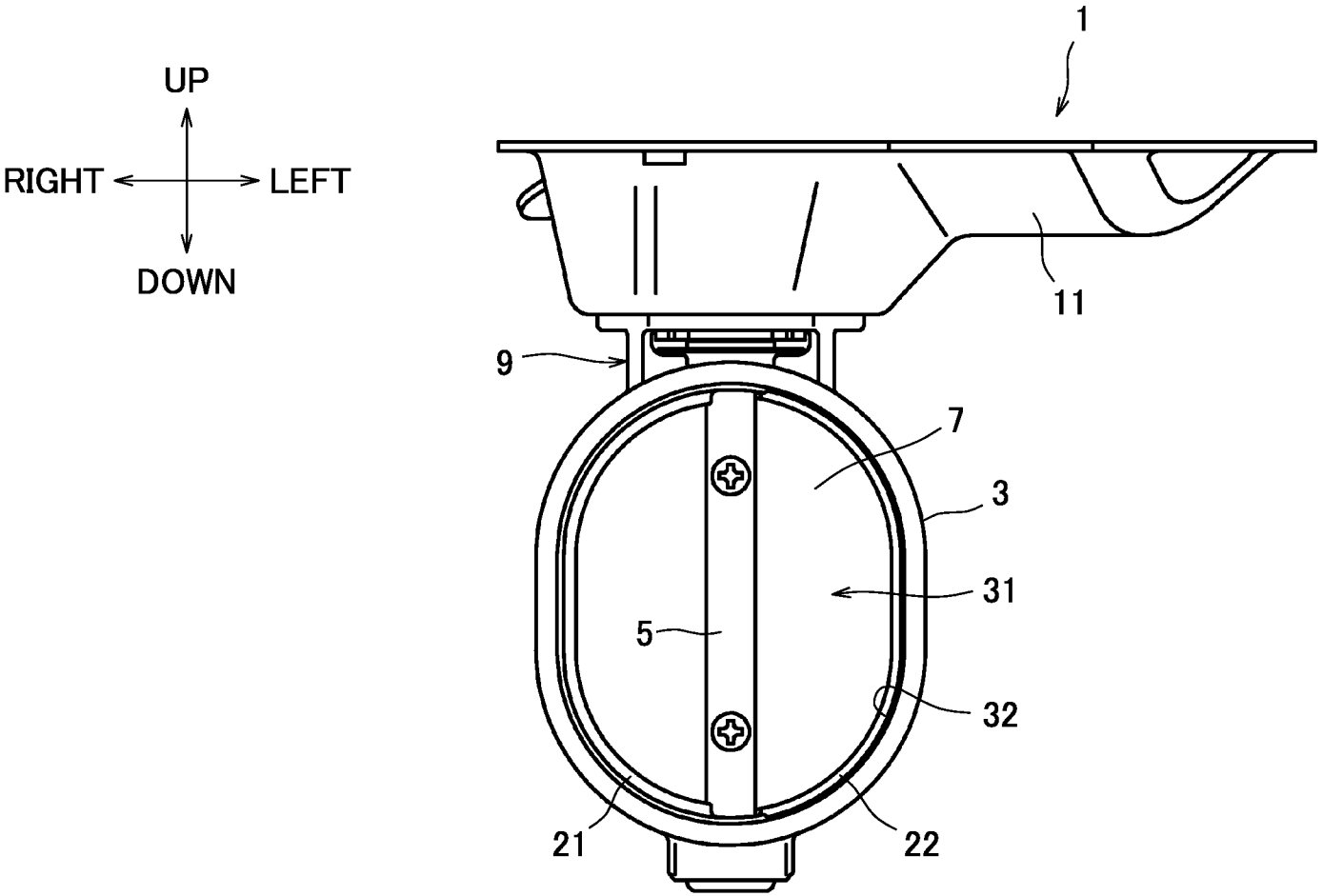
FIG. 12 is a diagram illustrating another example of an application to a valve body having a bore with an elliptic section.
Figure 13:
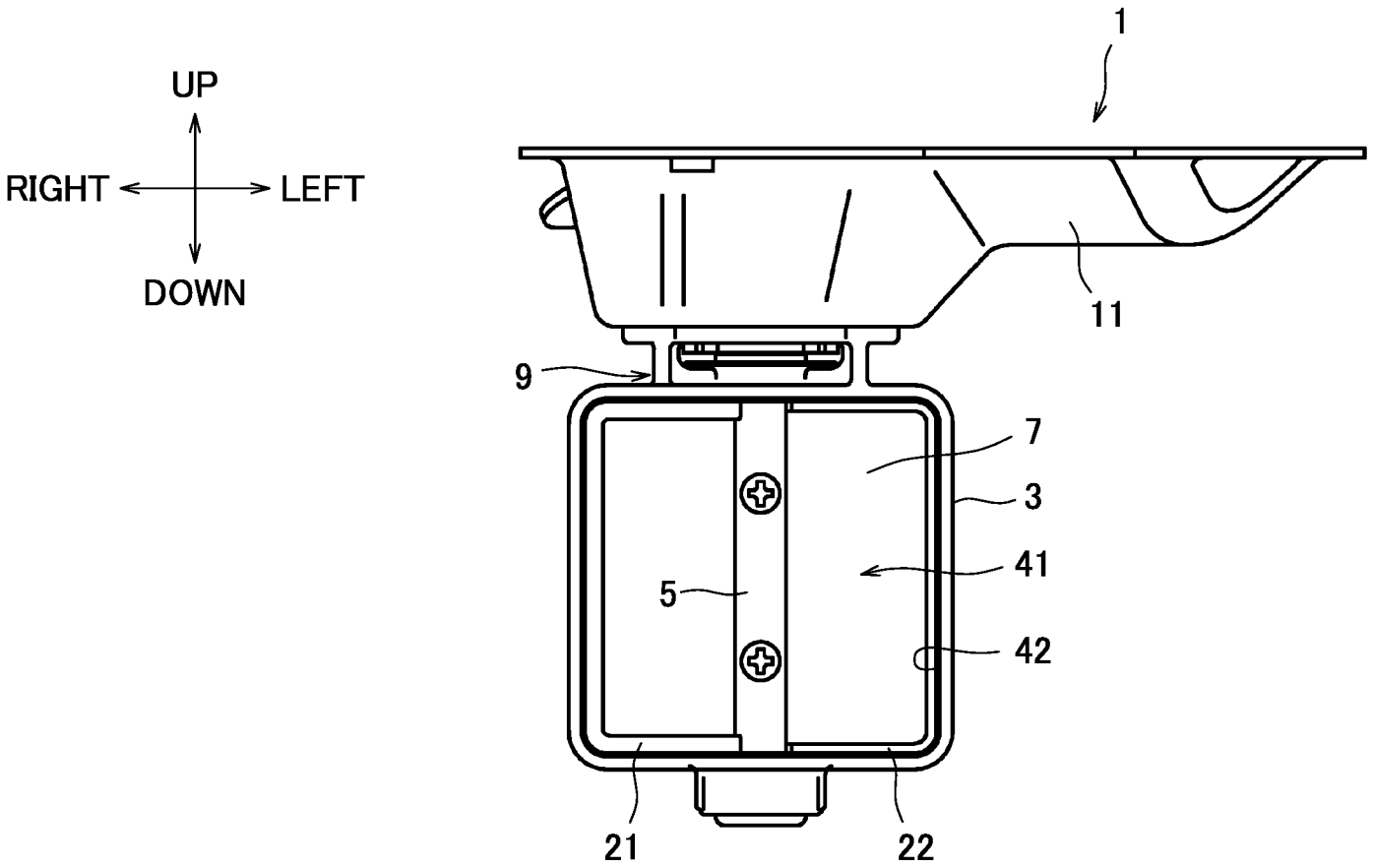
FIG. 13 is a diagram illustrating yet another example of an application to a valve body having a bore with a square section.

Also, the diameter enlarged portions 25 with arc-shaped sections are formed to correspond to the bore 4 with a circular section formed in the valve body 3 in the aforementioned embodiment. However, in a case of a bore with another sectional shape, the sectional shape of the diameter enlarged portions may be set in accordance with the sectional shape of the bore. In a case in which a bore 31 of the valve body 3 has an elliptical sectional shape as illustrated in FIG. 12, for example, it is only necessary to form a diameter enlarged portion 32 with an elliptical sectional shape by enlarging the inner shape of the bore 31. Also, in a case in which a bore 41 of the valve body 3 has a square sectional shape as illustrated in FIG. 13, it is only necessary to form a diameter enlarged portion 42 with a square sectional shape by enlarging the inner shape of the bore 41.

REFERENCE SIGNS LIST

1 Exhaust valve device
3 Valve body
4, 31, 41 Bore
5 Rotating shaft
7 Valve element
7*a* Right side portion (one side portion)
7*b* Left side portion (other side portion)
13 Motor unit (actuator)
21 Front sealing projection
21*a*, 22*a* Sealing surface
21*b*, 22*b* R-shaped corner (corner)
22 Back sealing projection
25, 27, 32, 42 Diameter enlarged portion (extended portion)

What is claimed is:

1. An exhaust valve device for a vehicle comprising:

a valve body comprising a bore through which exhaust gas is distributed, the valve body being produced through casting;

a valve element supported in the bore by a rotating shaft axially supported by the valve body and driven to be opened and closed between a fully opened position and a fully closed position by an actuator around the rotating shaft at the center;

a pair of sealing projections integrally formed on an inner circumferential surface of the bore to follow one side portion and the other side portion of an outer circumferential edge of the valve element at the fully closed position with the rotating shaft interposed therebetween;

a pair of sealing surfaces formed on the sealing projections, the one side portion and the other side portion of the outer circumferential edge of the valve element having been turned to the fully closed position abutting respectively on the sealing surfaces;

a pair of R-shaped corners with R-shaped sections formed between the inner circumferential surface of the bore and the sealing surfaces when the valve body is casted; and a pair of extended portions formed in regions in the inner circumferential surface of the bore to enlarge the bore, the regions being adjacent respectively to the sealing surfaces of the sealing projections and correspond to lengths of the sealing surfaces, wherein the valve element has an outer shape enlarged to correspond to a height of the R-shaped corners on an outer circumferential side in the bore with formation of the extended portions at the fully closed position at which the one side portion and the other side portion of the outer circumferential edge are caused to abut on the sealing surfaces.

2. The exhaust valve device for a vehicle according to claim 1, wherein a depth of the extended portions by which the bore is enlarged is set to be substantially equal to the height of the R-shaped corners.

3. The exhaust valve device for a vehicle according to claim 1, wherein the extended portions have slope-shaped sections with a depth gradually decreasing further away from the sealing surfaces.

4. The exhaust valve device for a vehicle according to claim 1, wherein the bore has a circular section, and the extended portions have arc-shaped sections formed by enlarging an inner diameter of the bore.

5. The exhaust valve device for a vehicle according to claim 1, wherein the bore has an elliptical section, and the extended portions have elliptical sections formed by enlarging an inner shape of the bore.

6. The exhaust valve device for a vehicle according to claim 1, wherein the bore has a square section, and the extended portions have square sections formed by enlarging an inner shape of the bore.

* * * * *